US007048335B2

(12) United States Patent
Norman et al.

(10) Patent No.: US 7,048,335 B2
(45) Date of Patent: May 23, 2006

(54) SEATING UNIT WITH CROSSBAR SEAT SUPPORT

(75) Inventors: Christopher J. Norman, Byron Center, MI (US); Kurt R. Heidmann, Grand Rapids, MI (US); Robert J. Battey, Middleville, MI (US); Jeffrey A. Hall, Grand Rapids, MI (US); Gary Lee Karsten, Wyoming, MI (US)

(73) Assignee: Steelcase Development Corporation, Caledonia, MI (US)

( * ) Notice: Subject to any disclaimer, the term of this patent is extended or adjusted under 35 U.S.C. 154(b) by 0 days.

(21) Appl. No.: 10/845,978

(22) Filed: May 14, 2004

(65) Prior Publication Data

US 2004/0245828 A1 Dec. 9, 2004

Related U.S. Application Data

(63) Continuation-in-part of application No. 10/792,309, filed on Mar. 3, 2004, which is a continuation-in-part of application No. 10/455,076, filed on Jun. 5, 2003, now Pat. No. 6,880,886.

(51) Int. Cl.

| | |
|---|---|
| ***A47C 1/024*** | (2006.01) |
| ***A47C 1/038*** | (2006.01) |
| ***A47C 3/026*** | (2006.01) |
| ***A47C 7/00*** | (2006.01) |

(52) U.S. Cl. ..... 297/300.2; 297/300.1; 297/300.5; 297/342; 297/440.1; 297/440.15

(58) Field of Classification Search ..... 297/440.15, 297/440.2, 440.22, 285, 286, 289, 300.6, 297/300.7, 300.8, 301.5, 301.6, 301.7, 300.2, 297/300.5

See application file for complete search history.

(56) References Cited

U.S. PATENT DOCUMENTS

| | | | |
|---|---|---|---|
| 868,052 | A | 10/1907 | Wilmot |
| 1,888,471 | A | 11/1932 | Robbins |
| 2,471,024 | A | 5/1949 | Cramer |
| 3,934,932 | A | 1/1976 | Ekornes |
| 4,126,355 | A | 11/1978 | Rosenheck |
| 4,695,093 | A | 9/1987 | Suhr et al. |
| 4,840,426 | A | 6/1989 | Vogtherr et al. |
| 4,877,291 | A | 10/1989 | Taylor |
| 4,984,846 | A | 1/1991 | Ekornes |
| 5,209,549 | A | 5/1993 | Chang |
| RE34,354 | E | 8/1993 | Sondergeld |

(Continued)

FOREIGN PATENT DOCUMENTS

| | | |
|---|---|---|
| EP | 0 434 897 A1 | 7/1991 |

(Continued)

*Primary Examiner*—Rodney B. White
(74) *Attorney, Agent, or Firm*—Price, Heneveld, Cooper, DeWitt & Litton LLP

(57) ABSTRACT

A seating unit includes a base having a housing and support arms extending laterally on each side of the housing. A back frame is pivoted to the support arms on each side, and a slide slidably engages the housing. A seat-supporting structure includes a crossbar pivotally attached to the slide member at a first pivot location and side frame sections extending rearwardly from ends of the crossbar that are pivotally attached to the lower arms of the back at a second pivot location spaced horizontally from the first pivot locations to define a three-point support for a seat above the housing. A spring is operably coupled to the slide to bias the back and seat toward upright positions.

52 Claims, 14 Drawing Sheets

U.S. PATENT DOCUMENTS 5,249,839 A 10/1993 Faiks et al.
5,251,958 A 10/1993 Roericht et al.
5,366,274 A 11/1994 Roericht et al.
5,385,388 A 1/1995 Faiks et al.
5,472,261 A 12/1995 Oplenskdal et al.
5,486,035 A 1/1996 Koepke et al.
5,597,203 A 1/1997 Hubbard
5,871,258 A 2/1999 Battey et al.
5,934,758 A 8/1999 Ritch et al.
5,979,984 A 11/1999 De Kraker et al.
6,050,642 A 4/2000 Erb
6,086,153 A * 7/2000 Heidmann et al. ..... 297/300.1
6,116,695 A * 9/2000 Heidmann et al. ..... 297/463.1
6,149,236 A 11/2000 Brauning
6,224,160 B1 * 5/2001 Takeuchi et al. ..... 297/440.15
6,394,548 B1 * 5/2002 Battey et al. ..... 297/342
6,394,549 B1 * 5/2002 DeKraker et al. ..... 297/342
6,517,156 B1 2/2003 Lin
6,536,841 B1 3/2003 Pearce et al.
6,554,360 B1 4/2003 Wilke et al.
6,609,755 B1 8/2003 Koepke et al.
6,644,749 B1 * 11/2003 VanDeRiet et al. ..... 297/440.1
6,669,292 B1 12/2003 Koepke et al.
6,679,553 B1 1/2004 Battey et al.
6,685,267 B1 * 2/2004 Johnson et al. ..... 297/300.1
6,758,523 B1 * 7/2004 VanDeRiet et al. ..... 297/300.5
6,837,546 B1 * 1/2005 VanDeRiet et al. ..... 297/440.1
6,863,346 B1 * 3/2005 Zund ..... 297/322
6,905,171 B1 * 6/2005 Knoblock et al. ..... 297/300.1
2002/0017809 A1 * 2/2002 Knoblock et al. ..... 297/300.1
2002/0043845 A1 * 4/2002 VanDeRiet et al. ..... 297/303.5
2002/0171276 A1 * 11/2002 Bock ..... 297/300.1
2002/0180248 A1 12/2002 Kinoshita et al.
2003/0015902 A1 * 1/2003 Knoblock et al. ..... 297/300.1
2004/0000805 A1 * 1/2004 VanDeRiet et al. ..... 297/300.1
2004/0004380 A1 * 1/2004 Horiki et al. ..... 297/300.5
2004/0051358 A1 * 3/2004 Bodnar et al. ..... 297/300.1
2005/0029848 A1 * 2/2005 Heidmann et al. ..... 297/300.1

FOREIGN PATENT DOCUMENTS

EP 0 490 131 A1 6/1992

* cited by examiner

SEATING UNIT WITH CROSSBAR SEAT SUPPORT

CROSS REFERENCE TO RELATED APPLICATIONS

This application is a continuation-in-part of co-assigned co-invented application Ser. No. 10/792,309, filed Mar. 3, 2004, entitled COMBINED TENSION AND BACK STOP FUNCTION FOR SEATING UNIT, (now Patent No. 6,932,430), which is a continuation-in-part of Ser. No. 10/455,076, filed Jun. 5, 2003, now U.S. Pat. No. 6,880,886, entitled COMBINED TENSION AND BACK STOP FUNCTION FOR SEATING UNIT (now Patent No. 6,880,886), the entire contents of which are incorporated herein in their entirety. This application is also related to the following applications: Ser. No. 10/241,955, filed Sep. 12, 2002, entitled SEATING UNIT HAVING MOTION CONTROL (now Patent No. 6,869,142); Ser. No. 10/455,503, filed Jun. 5, 2003, entitled CONTROL MECHANISM FOR SEATING UNIT; Ser. No. 10/455,487, filed Jun. 5, 2003, entitled SEATING WITH COMFORT SURFACE; and Ser. No. 10/846,784, filed on May 14, 2004 , entitled COMFORT SURFACE FOR SEATING, the entire contents of each of which are also incorporated herein by reference in their entirety.

BACKGROUND

The present invention relates to seating units having a seat support and back coupled to a base for synchronous movement and having an energy device biasing the seat support and back to upright positions.

Synchrotilt chairs provide a seat that moves simultaneously with recline of its back, such as to reduce "shirt pull" upon recline, to improve comfort, and to promote healthier support when performing tasks while seated for extended periods of time. In one type of synchrotilt chair, the seat moves forward upon recline of its back, so that a seated user's hands stay relatively stationary whether the back is in the upright or reclined position. This is not easily accomplished, since it requires a mechanism that creates stable and smooth forward movement of the seat during rearward recline of the back. Also, it is desirable to reduce cost, weight, and assembly time, and to accomplish this with simplified components. At the same time, the competitive furniture market requires high quality and durability. There are many conflicting and challenging design requirements, such as the desire for small package size, while maintaining an attractive appearance, an environmental "green" friendliness (including the ability to separate components into recyclable parts without substantial effort), and a desire for design flexibility, relatively few components, and mechanically-efficient arrangements that are durable, long-lasting, robust, and easily assembled.

One prior art chair disclosed in Battey et al. U.S. Pat. No. 5,871,258 (and several related patents) includes a seat and a back operably supported for synchronous movement between upright and reclined positions, with the seat moving forwardly upon recline of the back. The energy mechanism in this patent disclosure is of interest (and is claimed primarily in related U.S. Pat. No. 6,086,153); the seat is of interest (and is claimed primarily in U.S. Pat. No. 5,871,258 and also see related U.S. Pat. Nos. 5,909,923 and 5,979,984); and the back is of interest (and is initially claimed in U.S. Pat. No. 5,975,634 but also see several subsequent applications continued from U.S. Pat. No. 6,086,153). However, improvements are desired in the chair disclosed in Battey '258 (and related patents) to simplify components, reduce parts and pieces, make them lower in weight and cost, improve assembly and reduce manual labor during assembly, and to make the assembly more durable and robust.

Thus, a system having the aforementioned advantages and solving the aforementioned problems is desired.

SUMMARY OF THE PRESENT INVENTION

In one aspect of the present invention, a seating unit includes a base having a housing and at least one support arm extending laterally relative to each side of the housing. A force-generating device is positioned within the housing, and a seat-supporting structure includes a crossbar operably attached to the force-generating device and extends laterally relative to the housing. The crossbar is operably supported for movement in a generally fore-and-aft direction relative to the housing and is biased by the force-generating device in a first direction toward an upright position and is biased against movement in an opposite second direction toward a recline position. A seat is supported at least in part by the crossbar, with the seat support being operably positioned in spaced relation to the housing and being biased against movement in the second direction.

In another aspect of the present invention, a seating unit includes a base having a housing and support arms extending laterally and upwardly on each side of the housing, a back with lower arms pivoted to the support arms on each side, and a slide member slidably engaging the housing. A seat-supporting structure includes a crossbar pivotally attached to the slide member at a first pivot location and includes side frame sections extending from ends of the crossbar that are pivotally attached to the lower arms of the back at a second pivot location spaced horizontally from the first pivot location. The crossbar is adapted to move generally fore-and-aft relative to the housing, with the seat-supporting structure being adapted to stably support a seat above the housing. A biasing device is operably coupled to one of the back, the slide member and the seat-supporting structure that biases the back and the seat-supporting structure toward upright positions.

In another aspect of the present invention, a seating unit includes a base support structure, and a U-shaped seat-supporting structure having a crossbar slidably attached to the base support structure at a first location and having frame-engaging sections extending from ends of the crossbar. The frame-engaging sections are operably supported and coupled to the base support structure at a second pivot location spaced horizontally from the first location to define an arrangement including at least three non-aligned support points. The crossbar is adapted to move generally fore-and-aft relative to the base support structure. A seat is supported at the at least three non-aligned support points by the seat-supporting structure above the base support structure, and a biasing device is operably coupled to at least one of the base support structure, the seat-supporting structure, and the seat that biases the seat from a recline position toward an upright position.

In still another aspect of the present invention, a seat-supporting apparatus is provided for use in a seating unit, where the seating unit includes a control housing, a seat, and a back operably supported on the control housing for synchronous movement upon recline of the back. The seat-supporting apparatus includes a force-generating device positioned within the housing, and a seat-supporting structure with a crossbar operably attached to the force-generating device and extending laterally relative to the housing for supporting the seat over the housing. The crossbar is operably movably supported at least in part by the crossbar on the control housing for movement in a generally fore-and-aft direction relative to the housing and is biased by the force-generating device in a first direction toward an upright position and is biased against movement in the substantially opposite second direction toward a recline position.

In an additional aspect of the present invention, a thigh angle adjustment structure is provided on a seat with an adjustable thigh support surface, the adjustment structure including a rotatable handle with indicia oriented to correlate to the actual angle of the thigh support surface at any handle position.

In an additional aspect of the present invention, a thigh angle adjustment structure is provided on a seat with an adjustable thigh support surface, the adjustment structure including a handle connected to a pair of over-center connected links. The handle is movable between up and down positions for moving the thigh support surface to raised and lowered positions.

In an additional aspect of the present invention, a thigh angle adjustment structure is provided on a seat with an adjustable thigh support surface, the adjustment structure including a handle that is adjustable between a plurality of positions (more than just two positions), and that is movable to adjust the thigh support surface to a similar number of different angular positions.

In an additional aspect of the present invention, a seat structure is provided having a perimeter frame defining an opening, and a plurality of resilient members operably supported across the opening for distributing stress from point loads directed downwardly within the opening. The perimeter frame includes a front section having a rear edge that extends laterally to define a front of the opening, the rear edge having a curvilinear waterfall-shape and being configured to comfortably support a seated user even when the forwardmost ones of the resilient members are flexed and bent downwardly.

In an additional aspect of the present invention, a seat structure is provided having a perimeter frame defining an enlarged opening, and a sheet covering the opening for distributing stress from point loads directed downwardly within the opening. The perimeter frame includes a front section having a rear edge that extends laterally to define a front of the opening, the rear edge having a curvilinear waterfall-shape and being configured to comfortably support a seated user even when the sheet is flexed downwardly along the rear edge of the front section while supporting a seated user.

These and other aspects, objects, and features of the present invention will be understood and appreciated by those skilled in the art upon studying the following specification, claims, and appended drawings.

DETAILED DESCRIPTION OF PREFERRED EMBODIMENTS

Figure 1:
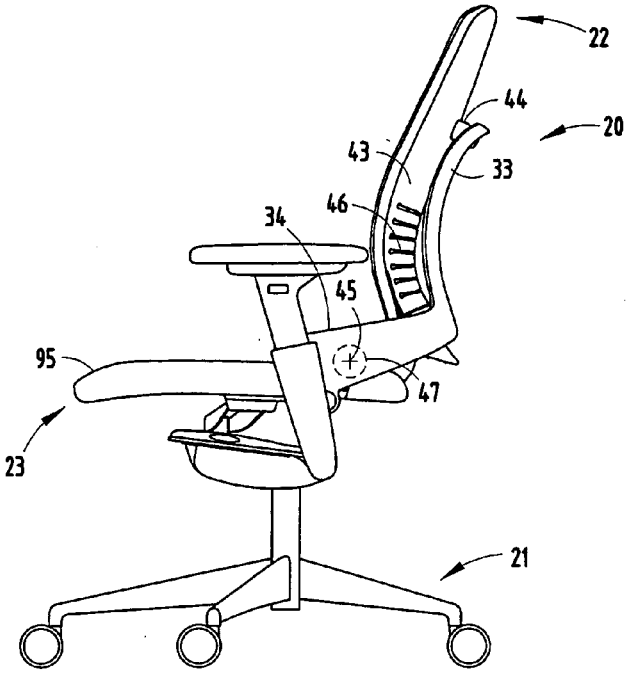
FIGS. 1–2 are side and front views of a seating unit embodying the present invention.

A seating unit 20 (FIG. 1) includes a base 21, a back 22 and seat 23 operably supported on the base 21 for synchronous movement between upright and reclined positions. The seat 23 is operably supported by a U-shaped seat-supporting structure 36 that provides a multi-point stable support arrangement for the seat 23 on the base 21, with the seat-supporting structure 36 being a relatively simple yet very effective structural component that offers reduced weight, reduced cost, compact size, and robust support for the seat 23.

Figure 7:
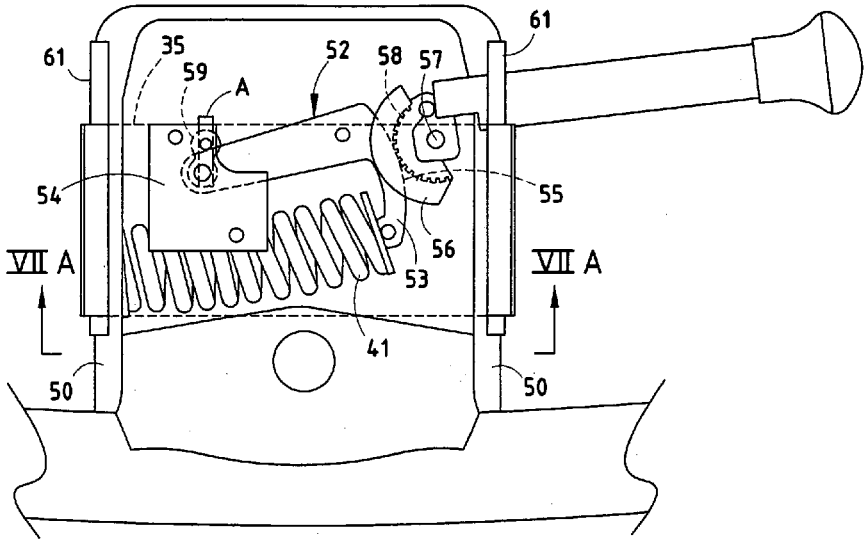
FIG. 7 is a top view of the control housing and energy mechanism of FIG. 3.
Figure 7A:
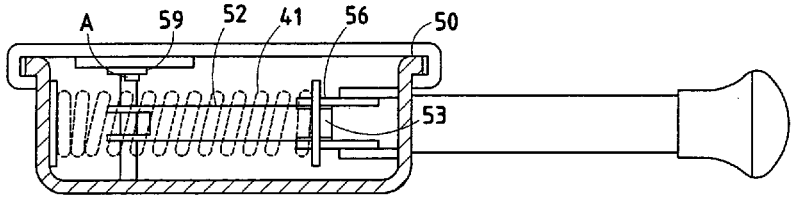
FIG. 7A is a cross-sectional view taken along the line VIIA—VIIA in FIG. 7.

The base 21 includes a spider-legged arrangement with castors, and a height-adjustable post. The base 21 (FIG. 3) includes a housing 31 fixed atop the post and support arms 32 extending laterally and upwardly on each side of the housing 31. The back 22 includes an arched U-shaped back frame 33 with lower end sections (i.e. arms 34) pivoted to the stationary support arms 32 on each side. A slide member 35 slidably engages the housing 31. A seat-supporting structure 36 includes a crossbar 37 pivotally attached to the slide member 35 at a first pivot location 38 and side frame sections 39 that extend rearwardly from ends of the crossbar 37. The ends of the side frame sections 39 are pivotally attached to the lower arms 34 of the back frame 33 at a second pivot location 40 spaced horizontally from the first pivot location 38. The sliding pivot location 38 and the second pivot location 40 define a multi-point stable support for a seat 23 above the housing 31. A spring 41 (FIG. 7) is operably coupled to the slide member 35 to bias the back frame 33 and seat-supporting structure 36 toward their respective upright positions.

The back 22 (FIG. 1) includes a back shell 43 supported on the back frame 33 at top and bottom pivot locations 44 and 45. The back shell 43 includes a lumbar region 46 that is flexible for comfortably supporting a seated user, and further includes a spring 47 biasing the back shell 43 toward a forwardly protruding shape. The present description is sufficient for an understanding of the present invention, but if additional detail is desired, it can be found in Battey U.S. Pat. No. 5,871,258 which discloses additional detail of a back arrangement similar to the back 22. The entire contents of Battey U.S. Pat. No. 5,871,258 are incorporated herein in their entirety by reference.

The housing 31 (FIG. 4) is supported on the base 21, and includes sidewalls 50 providing a recess into which a biasing device (i.e. coil spring 41) is positioned. An L-shaped torque arm 52 (FIG. 7) is also operably positioned in the recess and includes a first leg 53 engaging an end of the spring 41, and a second leg 54. A back surface of the first leg 53 defines a row of teeth 55. A half-disk-shaped support 56 is supported by a pivot pin 57, and includes an arcuate row of teeth 58 that mate with the teeth 55 to pivotally support the torque arm 52 with a non-slip configuration. The second leg 54 has an end attached to a link 59 that is in turn connected to the slide member 35. The slide member 35 includes bearings 61 that slidably engage the housing 31, such as by slidably engaging the top edges of the sidewalls 50. As will be understood below, when a seated user reclines the back 22, the slide member 35 is moved forward by arms 34, causing the L-shaped torque arm 52 (FIG. 7) to pivot on arcuate support 56, thus compressing the spring 41. This provides a resistance to recline of the back 22, since the seat 23 is connected to the back frame 33, as described above. Notably, the half-disk-shaped support 56 is rotatably adjustable to adjust a length of the torque arm defined by the first leg 53, thus providing an easily operated spring tension adjustment mechanism. The above discussion of the biasing device and system and system operation are sufficient for an understanding of the present invention, but it is noted that they are described in detail in Battey U.S. Pat. No. 5,871,258, which was incorporated by reference above.

Figure 4:
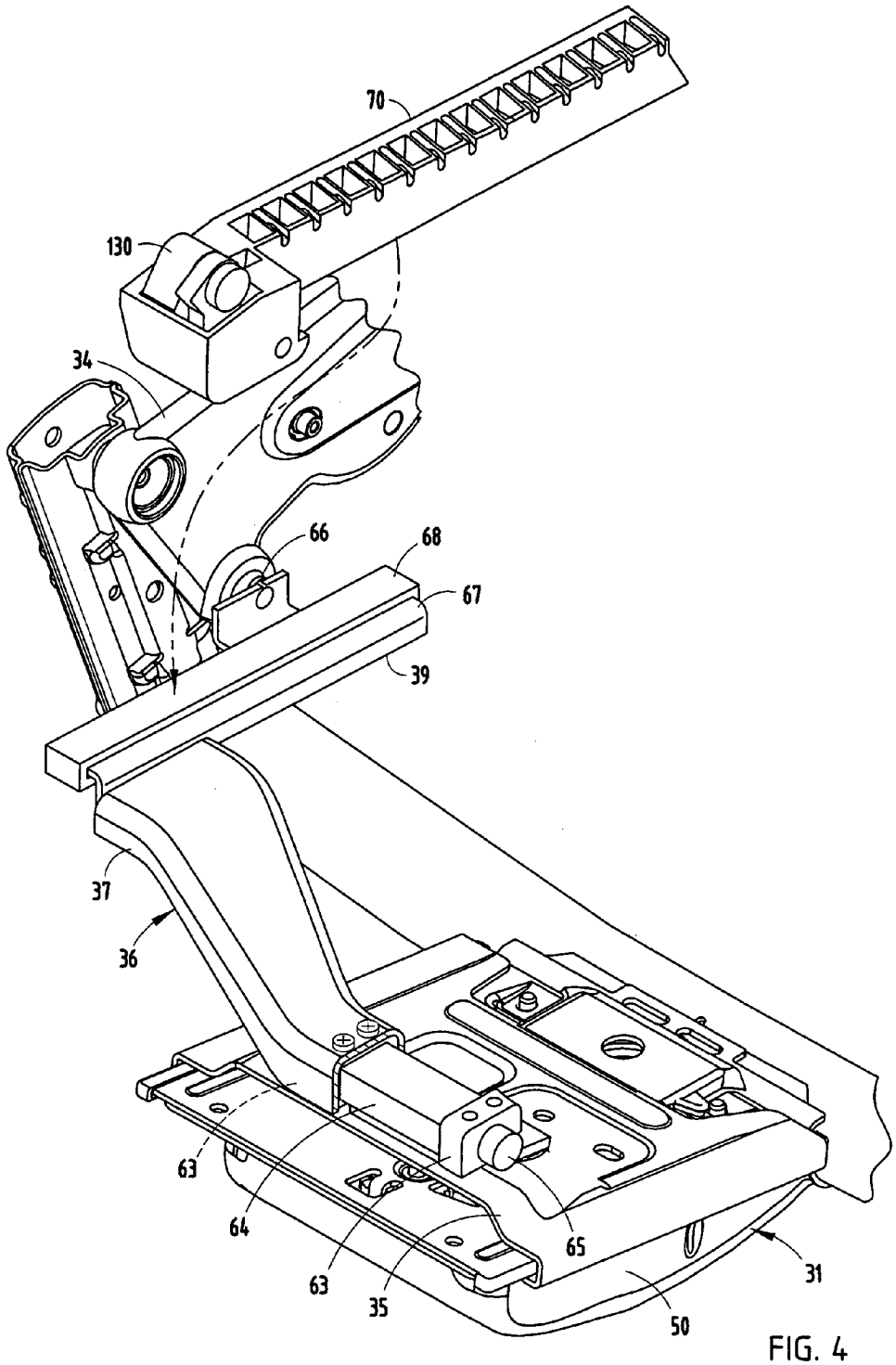
FIG. 4 is a fragmentary perspective view of the control housing and crossbar/seat-supporting structure.

The seat-supporting structure 36 (FIG. 4) includes the crossbar 37 and side frame sections 39 rigidly fixed to the crossbar 37 and extending rearwardly. The illustrated side frame sections 39 extend only rearwardly, but it is contemplated that the side frame sections 39 could extend forwardly (see the embodiment of FIG. 15, with crossbar 37A and side frame members 39A). Alternatively, it is contemplated that the side frame members could extend both forwardly and rearwardly, and/or could form part of a perimeter frame supporting a seat and that is supported by the crossbar above a base and control housing. The crossbar 37 has a lower center section with a pair of apertured down tabs 63. A mounting block 64 is attached to a top of the slide member 35, and fits between the down tabs 63 where it is pivotally secured to the down tabs 63 by a pivot pin 65 (FIG. 4). It is contemplated that a variety of other pivot arrangements can also be constructed that will work in the present invention.

The side frame sections 39 (FIG. 4) have protrusions 66 that extend outwardly from tail ends of the frame section 39 into pivotal engagement with mating structures on the support arms 34 of the back 22. The protrusions 66 are located horizontally rearwardly of the mounting block 64 and pivot pin 65, to thus provide a non-aligned multi-point support system for the seat-supporting structure 36. The mounting system provides a three point support where the mounting block 64 is relatively narrow, but it is noted that where the mounting block 64 is elongated, it might be considered a four point support arrangement. The points of support preferably should be horizontally spaced apart sufficiently to provide a stable seat support structure. It is contemplated that a horizontal spacing in a fore-aft direction of about 6 inches will provide sufficient stability. However, this dimension will change depending upon the structural stiffness and rigidity of the base 21, especially housing 31, cross bar 37, the seat 23, and other structural components of the chair 20.

Figure 3:
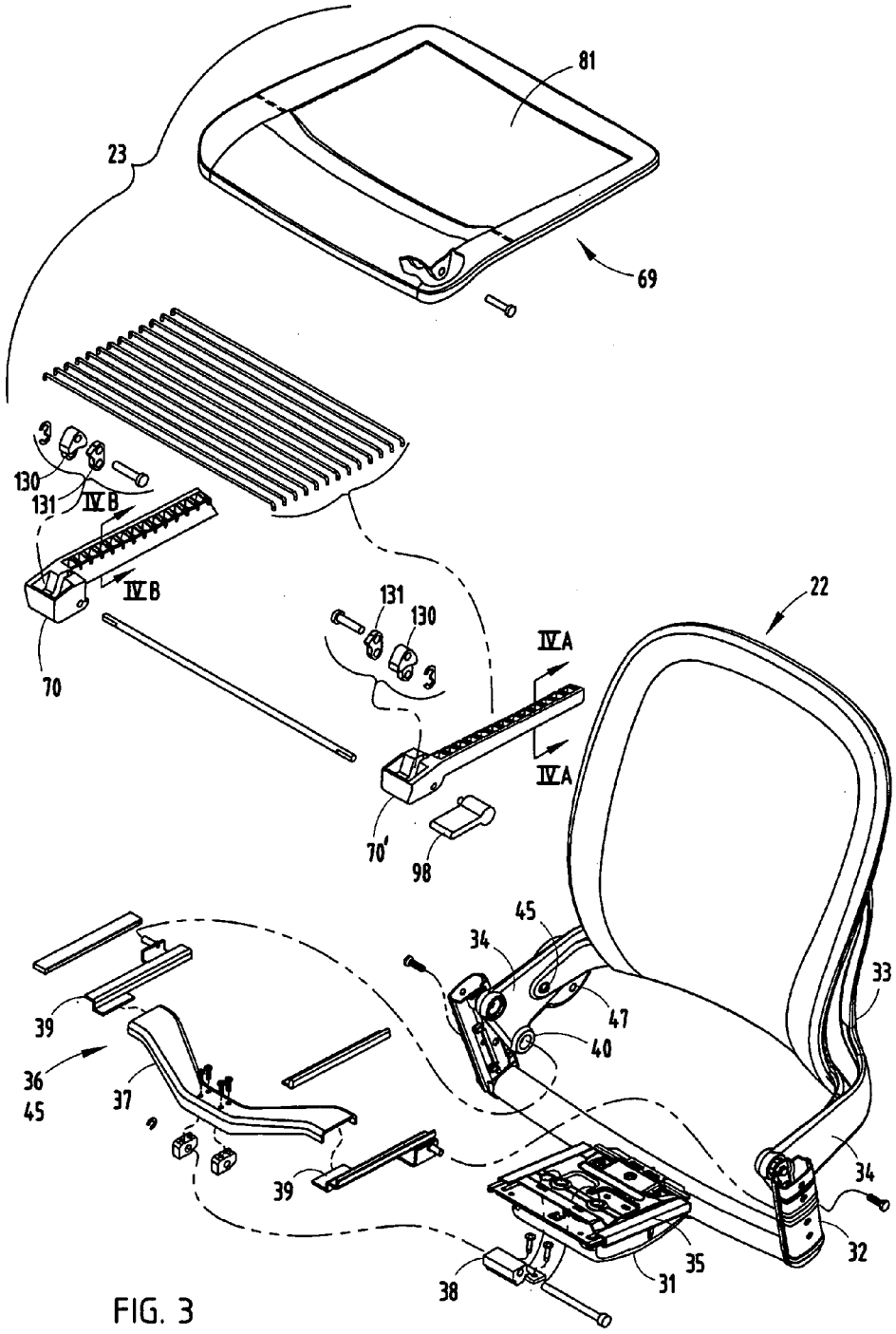
FIG. 3 is an exploded perspective fragmentary view of the seating unit of FIG. 1.
Figure 4A:
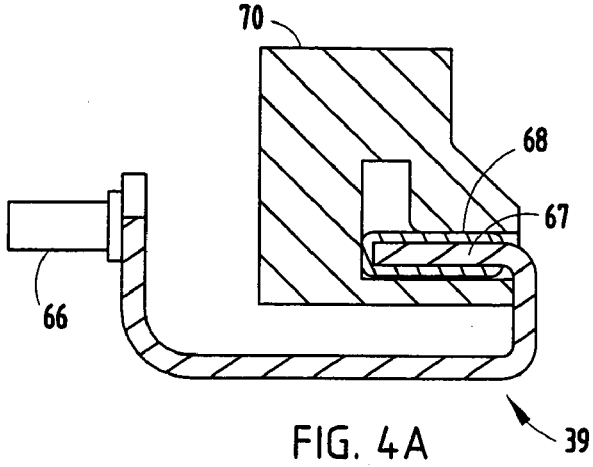
FIGS. 4A and 4B are cross-sectional views taken at the RH and LH rear pivots of the seat-supporting structure.
Figure 4B:
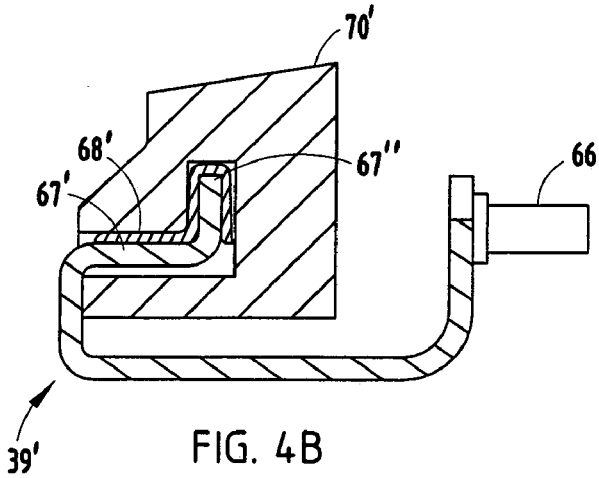
Figure 5:
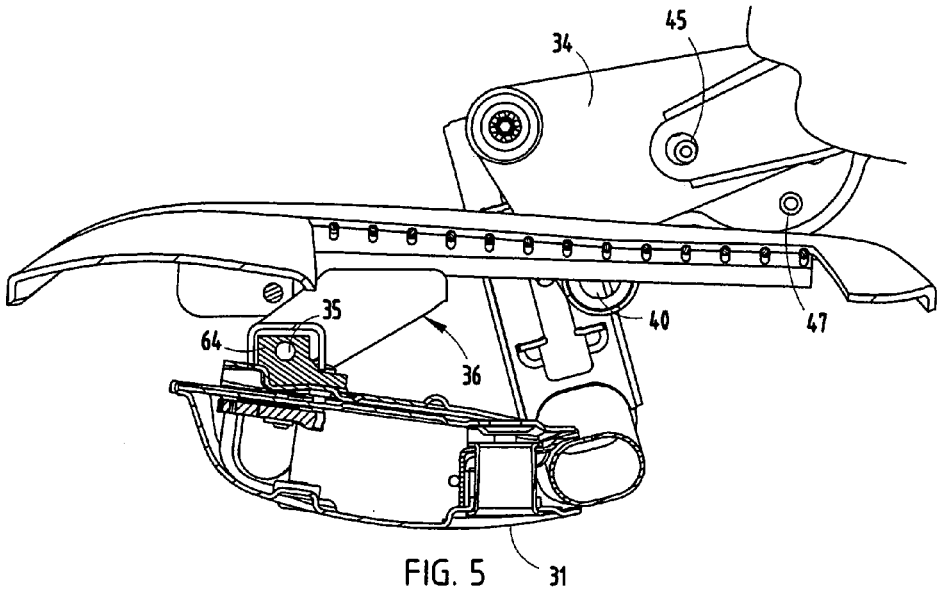
FIGS. 5–6 are cross-sectional views taken along the line V—V in FIG. 2 and the line VI—VI in FIG. 1, respectively.
Figure 6:
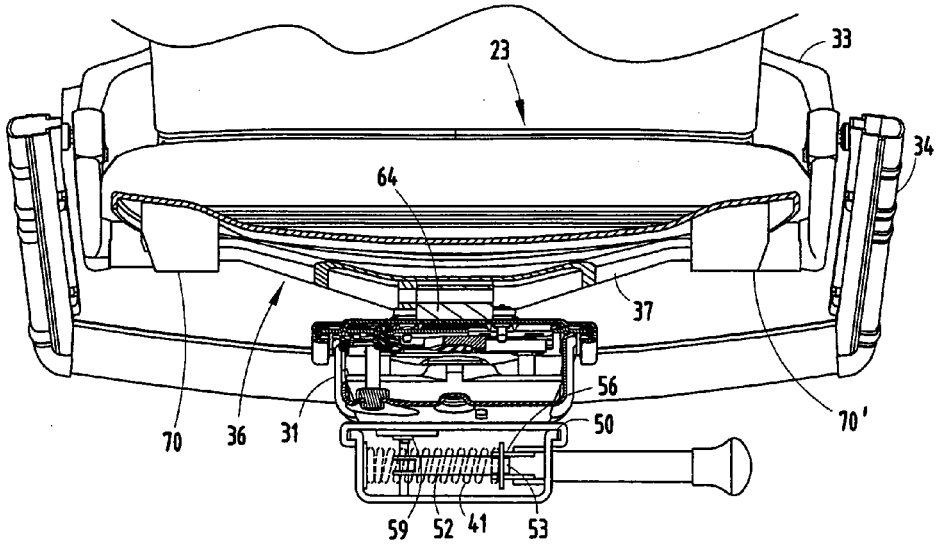

One of the side frame sections 39 (FIG. 4A) comprises a beam defining a flat horizontal bearing flange 67 and bearing cap 68, and the other of the side frame sections 39' (FIG. 4B) comprises a beam defining an L-shaped horizontal bearing flange 67' and bearing cap 68'. The seat 23 includes a perimeter frame 69 with side frame members 70 and 70' (FIG. 3) attached to each respective side. The side frame member 70 is shaped to mateably and slidably engage the bearing flange 67 and bearing cap 68 (FIG. 4A) and the side frame member 70' is shaped to mateably and slidably engage the bearing flange 67' and bearing cap 68' (FIG. 4B). Notably, the bearings 67, 67', 68, and 68' slidably support the seat 23 for fore-aft movement during seat depth adjustment, while the up flange 67" on bearing flange 67' serves to, guide the seat 23 as it moves in a fore-aft direction without binding. Notably, the up flange 67" forms a guide that is very resistant to the seat becoming skewed and bound up. This is due to the length to width ratio of the bearing 67'. It is contemplated that the present invention can be used with or without having a seat depth adjustment feature on the chair.

It is contemplated that the present inventive crossbar arrangement can be used with a wide variety of different seats. Nonetheless, the present illustrated seat is particularly comfortable, environmentally "green" friendly, and desirable for many reasons. Notably, a seat not unlike the illustrated seat is described in detail in pending application Ser. No. 10/792,309 which was incorporated by reference above.

Figure 10:
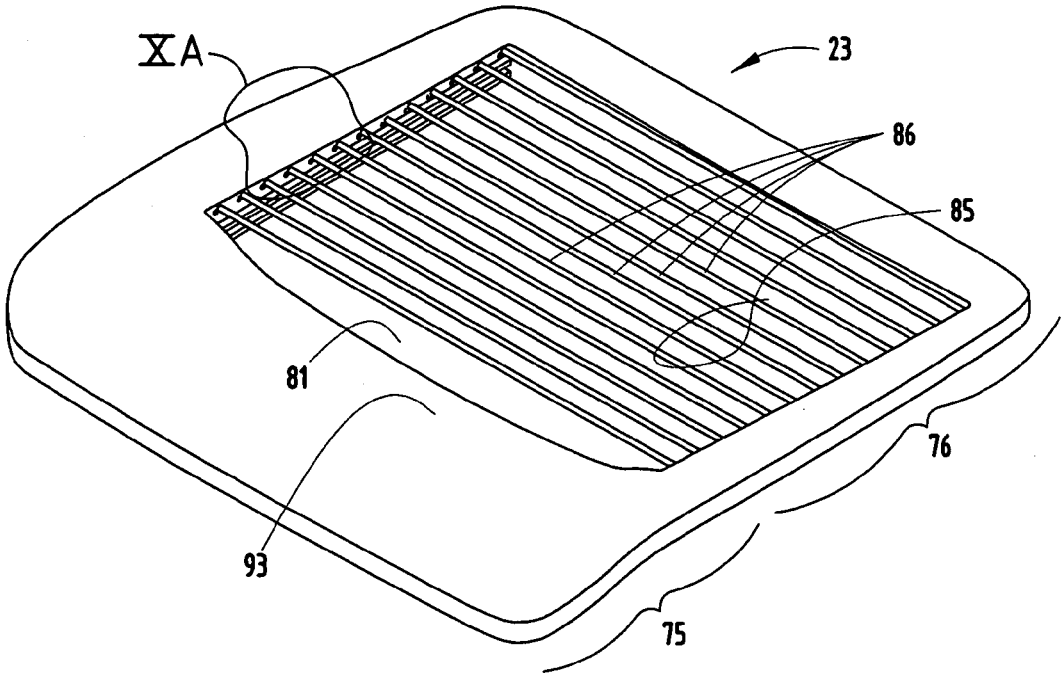
FIG. 10 is a perspective view of the seat of FIG. 3.

The illustrated seat 23 (FIG. 10) includes a front portion 75 and a rear portion 76 extending forward from the rear portion 75. It is noted that the front and rear portions 75 and 76 are particularly constructed to provide comfortable seating, while also being constructed to meet the difficult functional requirements of a seat. The difficult functional requirements for seats come from both use and abuse conditions. In "normal" use, a seated user will position themselves fully onto the seat, with their pelvis at a rear of the seat. However, seated users also often slouch (i.e. the seated user is leaning against the back 22, but their pelvis is near a front edge of the seat 23) or perch (i.e. the seated user is sitting upright, but his/her pelvis and full weight is near a front edge of the seat 23). Also, users sometimes abuse chairs by trying to stand on the seat. While this is strongly recommended against, it still is a condition that a chair may be subjected to and for which there are seating standards proposed by the Business and Furniture Industry Manufacturers Association (BIFMA), a trade association. When a person stands on a seat, substantial pressure is applied at whatever location they stand on, which may be in the front portion 75 or rear portion 76.

Figure 10A:
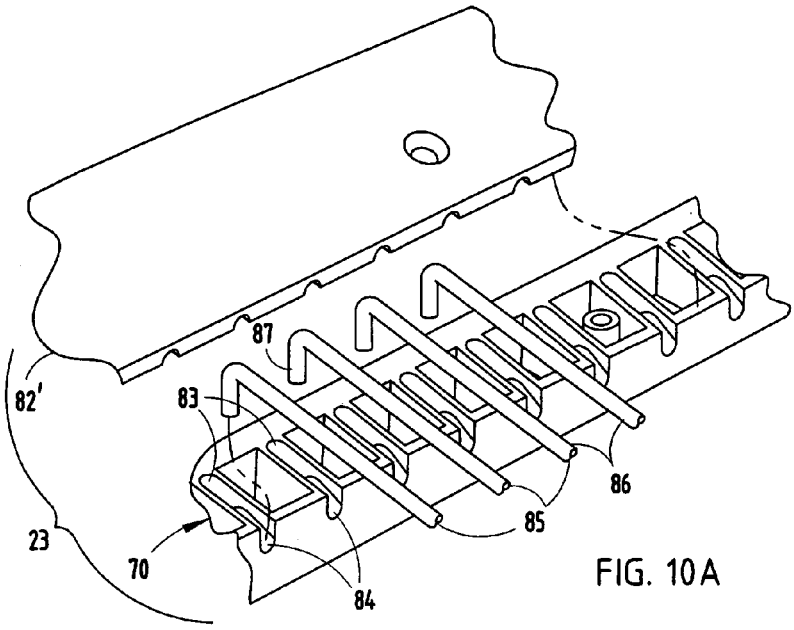
FIG. 10A is a fragmentary exploded perspective view of the seat in FIG. 10, and FIGS. 10B–10C are cross sections showing operative positions of the flexible members of FIG. 10.

The illustrated rear portion 76 (FIG. 3) includes the perimeter frame 69 and defines an opening 81. The perimeter frame 69 (FIG. 10A) is attached to the frame members 70 and a top cover 82' attached such as by screws or other known fasteners. The side frame members 70 integrally form the seat-depth-adjustment structure by the bearing arrangement shown in FIGS. 4A and 4B. Notches (not specifically shown) can be formed along the side frame members 70 and a seat depth latch can be operable positioned on the perimeter frame 69 for selectively engaging the notches to hold a selected seat depth adjusted position. (See the application Ser. No. 10/792,309, previously incorporated by reference.) Alternatively, a fixed attachment is used if seat depth adjustment is not desired. Notably, the illustrated perimeter frame 69 is surprisingly flexible and twistable in a direction perpendicular to the top seating surface when it is not attached to the seat-supporting structure 36, for reasons described below. Nonetheless, the seat-supporting structure 36 adds considerable strength against twisting-type flexure of the seat. The illustrated side frame members 70 define a series of pockets 83 and curved chute-like bearing surfaces 84. Resilient spring wire supports 85 have linear sections 86 that extend across the opening 81, and have L-shaped ends 87 that extend downwardly into the pockets 83. In an unstressed condition (FIG. 1B), the L-shaped ends 87 are near or abut an outboard end of the pockets 83. When a seated user rests on the linear sections 86 of the wire supports 85, the ends 87 are drawn toward each other. Notably, the pockets 83 permit inward movement of the ends 87 without inwardly stressing the opposing sides of the perimeter frame 69. (Notably, if the inward movement of the ends 87 were immediately resisted by the perimeter frame 69, there would be incredible pressure on the perimeter frame 69, due to the mechanical advantage caused by drawing the ends inward as a straight wire is bent in its middle area.) Because of the reduced strength requirement in the perimeter frame 69, its cross-sectional size can be reduced from chairs where a tensioned fabric is stretched across an opening in a seat frame.

Figure 10B:
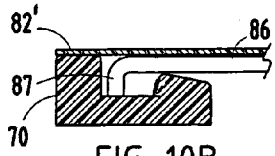
FIG. 10D is a view similar to FIG. 10B, but showing a modified wire support.
Figure 10C:
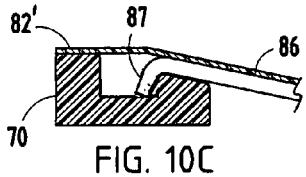

The surfaces (FIG. 10C) on the inboard end of the pockets 83 acts as a limit to inward movement of the L-shaped ends 87 in the event of substantial weight on one or more individual wire supports 85 (such as if a person stands on the seat 23). Notably, surfaces on the outboard ends of the pockets 83 can, if desired, be foreshortened and used to abut the L-shaped ends 87 to provide a pre-form or pre-stressed condition in the wire supports 85. Also, the wire supports 85 can be pre-bent to a desired non-linear shape if desired for spanning across the opening 81. The illustrated wire supports 85 are individual, spring metal and round in cross section, but it is contemplated that they can be loop-shaped or serpentine in shape or other shape, can have a flattened or other cross-sectional shape, and can be metal, plastic, composite, or other material.

Figure 10D:
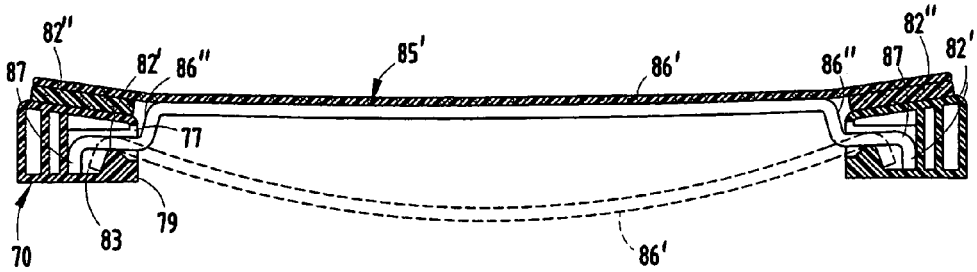

As noted below, a transition area is defined by rearward flange 93 along a front edge of the opening 81. It is noted that the wire supports 85 can be modified to reduce the need for lowering the flange 93. Specifically, the modified wire support 85' (FIG. 10D) includes an S-shaped bend at location 86" causing the linear section 86' to be elevated. This allows a thicker foam to be used on the cover 82' to improve seating comfort on the perimeter frame 69, while allowing a thin foam (or zero foam) on the wire supports 85. Notably, it is desirable to minimize the amount of foam on the wire supports 85 since "too much" foam would detract from the active independent support provided by the individual wire supports 85. This modification also allows for different design alternatives. For example, a cushion sheet 82" of uniform thickness can be rested on the cover 82', with the top surface of the cushion sheet 82" generally aligning with a top surface of the wire linear sections 86'. (See FIG. 10B.) A sheet of upholstery or fabric (not shown in FIG. 10D) can be laid on the foam cushion and stretched across the seat to cover both the cushion sheet 82" and the wire linear sections 86'. In the arrangement of FIG. 10D, the center area of the rear flange 93 does not need to be lower than the side areas.

Figure 12:
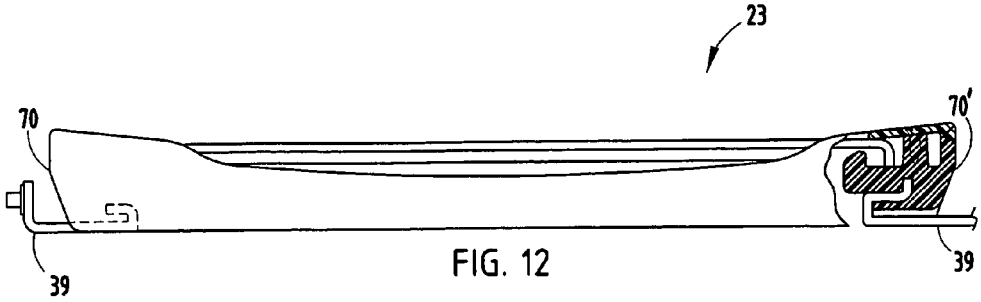
FIGS. 11–12 are top and front views of the seat of FIG. 3.
Figure 11:
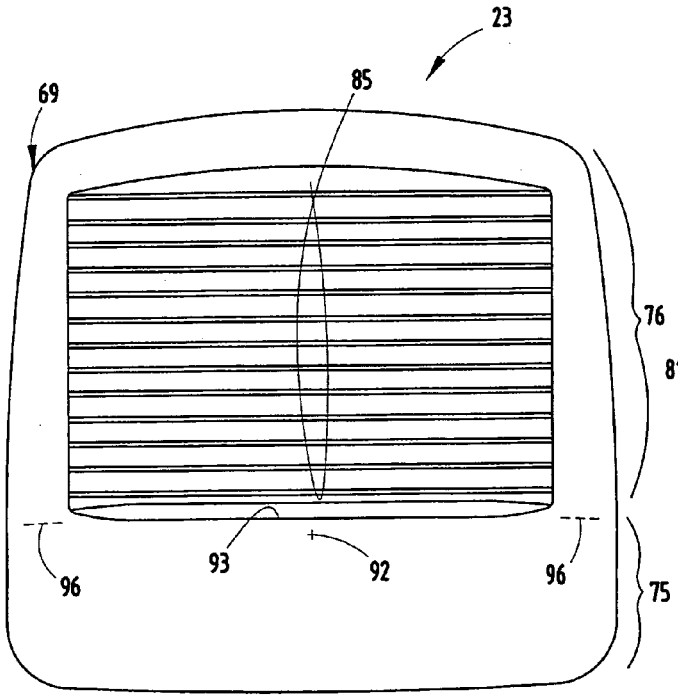
Figure 13:
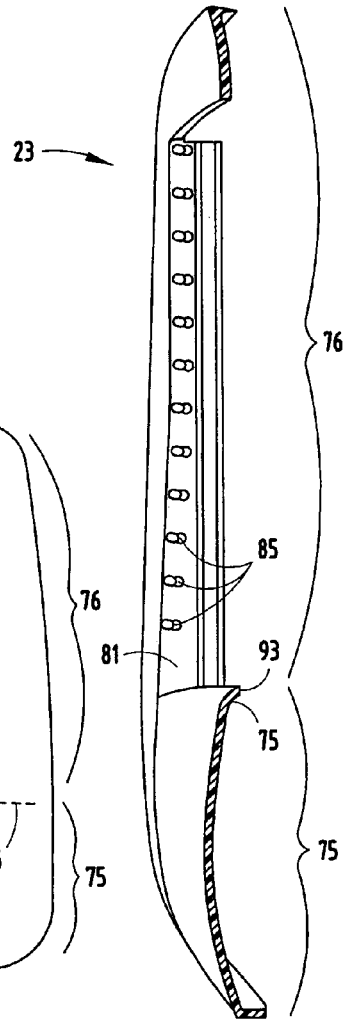
FIG. 13 is a cross section taken along the line XIII—XIII in FIG. 11.

The transition between the front and rear portions 75 and 76 is very important, given the flexibility and physical structure of the rear portion 76, including its perimeter frame 69 and the flexible resilient wire supports 85. This is especially true considering the angular adjustability of the front portion 75 on the rear portion 76, as discussed below. As illustrated in FIGS. 11–13, the front portion 75 (FIG. 13) has a "waterfall" shape, with its top surface being curved rearwardly and downwardly toward the opening 81 in the perimeter frame 69, and further it is curved forwardly and downwardly toward a front edge of the seat 23. A center rear region 92 of the front portion 75 is lower than edge portions, especially as the top surface curves toward the opening 81. In particular, the center rear region 92 can be up to an extra half inch below the top surface of the wire supports 85. Further, the rearwardly-extending flange 93 forming the rear edge facing the opening 81 is curved downwardly to form a transition that enhances comfort to a seated user who is slouching (i.e. where the person's weight is directed at an angle from a middle of the back 22 across the opening 81 and against the flange 93). Also, the lowering of the thigh area by one half inch below the wires 85 improves the transition thigh comfort and perching comfort by allowing for an extra half inch of foam in this area. The lowered area is only in a center region of the front portion 75 for aesthetic reasons.

Figure 2:
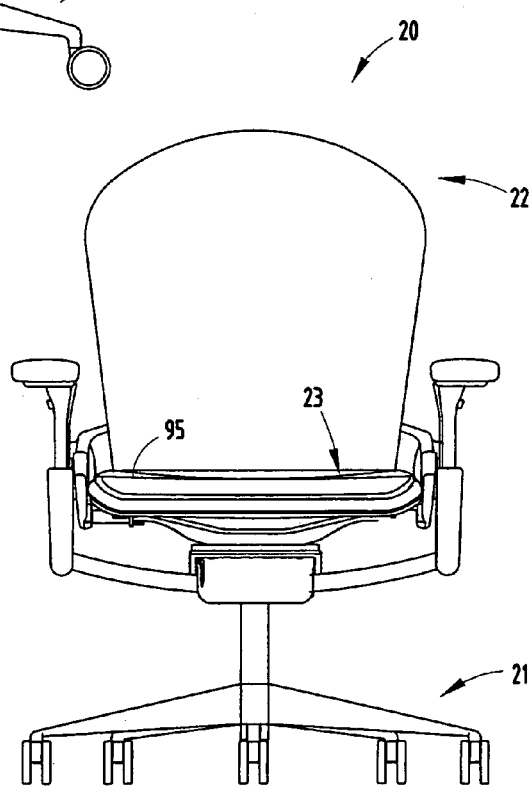

A cushion and/or fabric covering 95 (FIGS. 1–2) is placed on the seat 23, and is attached at its front and rear edges to the seat 23. A stiff strip (not specifically shown) is attached along front and rear edges of the illustrated fabric 95 and extends completely across the front and rear edge. The stiff strips are shaped to frictionally tuck into a channel in the front and rear portions 75 and 76. The present description is sufficient for a person skilled in chair design, but additional details are disclosed in the patent application Ser. No. 10/792,309, previously incorporated by reference to the extent they are necessary.

Figure 8:
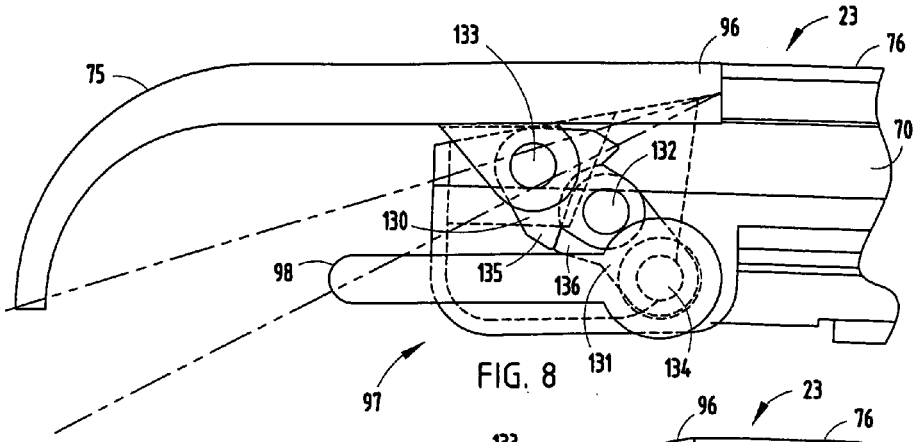
FIGS. 8–9 are fragmentary cross sections taken across a front of the seat similar to FIG. 5, FIG. 8 showing a thigh angle adjuster on the seat in a "normal" raised position, and FIG. 9 being in a "down-adjusted" lowered position.

The front portion 75 (FIGS. 8–9) includes a flexible region 96 connecting it to the rear portion 76. It is contemplated that the front portion 75 could be pivotally or slidably connected to the rear portion 76 as well. An adjuster 97 is mounted to change an angle of the front portion 75 relative to the rear portion 76. The illustrated adjuster 97 includes a pair of links 130 and 131 on each side of the chair fit within a pocket at a front of side frame members 70 and 70' (FIG. 3). The links 130 and 131 (FIG. 8) are pivoted to each other at pivot 132. The upper link 130 is pivoted to the front portion 75 at pivot 133 and the lower link 131 is pivoted to the associated side frame member 70. When moved over-center in a first direction (FIG. 8), stops 135 and 136 on the front portion 75 and the lower link 131 engage to limit rotation of the links 130 and 131. This causes the front portion 75 to stop in a first thigh-angle-supporting position. When moved over-center in a second direction (FIG. 9), stops 137 and 138 on the front portion 75 and the lower link 131 engage to limit rotation of the links 130 and 131. This causes the front portion 75 to stop in a second thigh-angle-supporting position. Thus, the adjuster 97 provides a two-position adjustment for the front portion 75 of the seat.

A modified adjuster 97' (FIG. 9A) is pivotally mounted by a pivot pin 98' to a mounting structure on a front of the side frame members 70'. The adjuster 97' includes a handle 98" and a spiral slot 99' that engages a guide pin 100' in a side of the front portion 75. The spiral slot 99' defines an increasing radius about the axis of the pivot pin 98'. The guide pin 100' is located forward of the flexible region 96 so that, as the adjuster 97' is rotated, the guide pin 100' follows the slot 99' and forces the front portion 75 angularly downwardly. (See FIG. 9A which shows a home or "normal" position in solid lines, and which shows a downwardly-adjusted position in dashed lines.) Thus, the adjuster 97' is operably attached to the front end of the side frame members 70 and to the front portion 75 for adjusting the front portion 75 between a first angled position (solid lines) for supporting the thighs of the seated user in a first use position and a second angled position (dashed line) for supporting the thighs in a second lower use position, and is movable to any position therebetween, thus providing infinite adjustability. Notably, the adjuster 97' can include slight continuous friction along its adjustment path, or it can include a plurality of detent bumps along the path to define discrete thigh angle positions.

Figure 9:
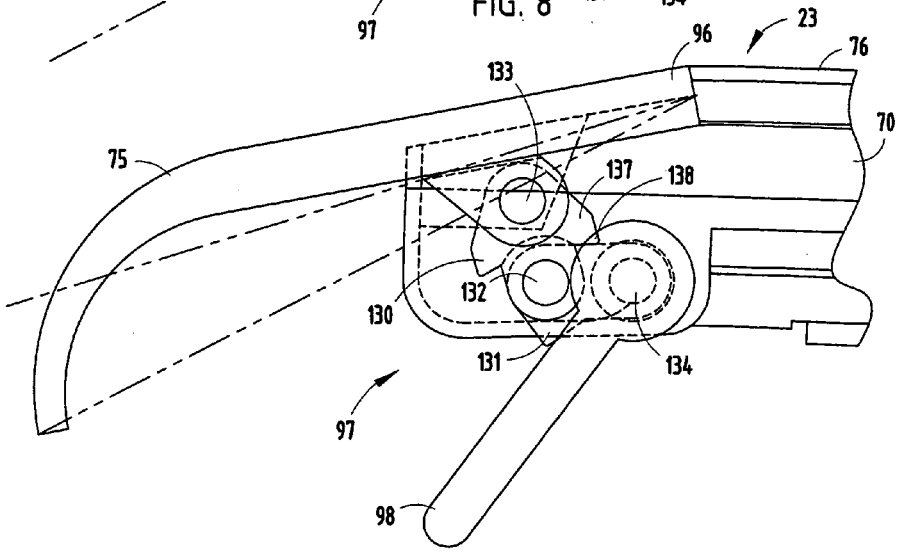
Figure 9A:
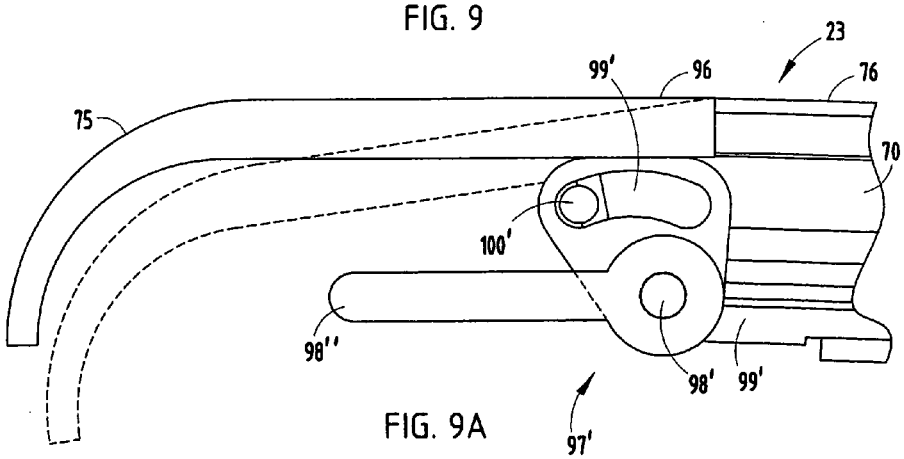
FIG. 9A is a view similar to FIG. 8 but of a modified thigh-angle adjuster that is infinitely adjustable.

The handle 98 of the adjuster 97 (FIG. 8) (and also handle 98" of adjuster 97') is elongated and has a flat surface that correlates to and generally aligns with the angular position of the front portion 75 when the front portion 75 is in either of its up position (FIG. 8) or down position (FIG. 9). Thus, a seated user immediately knows how the front portion 75 is adjusted, without having to move the handle 98 between positions. The seated user can tell where the adjuster 97 is set by feeling the handle 98 or by looking at the handle 98.

Figure 14:
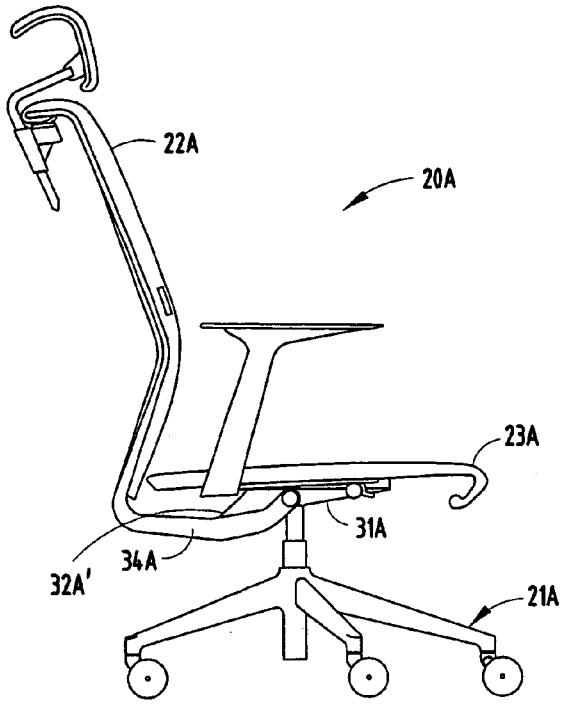
FIG. 14 is a side view of a second seating unit embodying aspects of the present invention.

A modified seating unit 20A (FIGS. 14–15) includes many similar features and aspects of the seating unit 20. In seating unit 20A, similar and identical components and features are identified by using the same identifying numbers but with the addition of the letter "A". This is done to reduce redundant discussion. The seating unit 20A is close to the seating unit disclosed in the application Ser. No. 10/792,309 previously incorporated herein by reference. The seating unit 20A is included herein to show a flexibility of the present inventive concepts, including especially the crossbar (37) and side frame sections (39).

Figure 15:
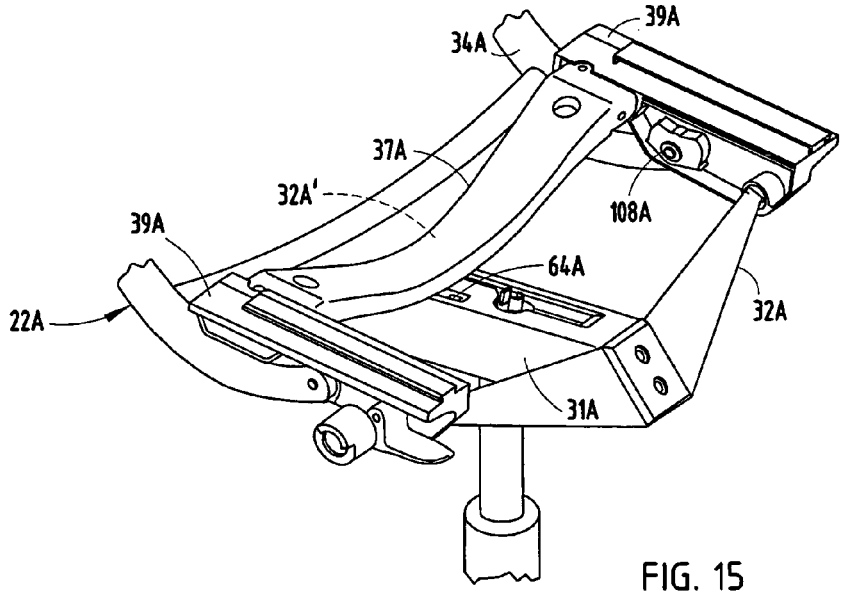
FIG. 15 is a perspective fragmentary view of the base of FIG. 14.
Figure 16:
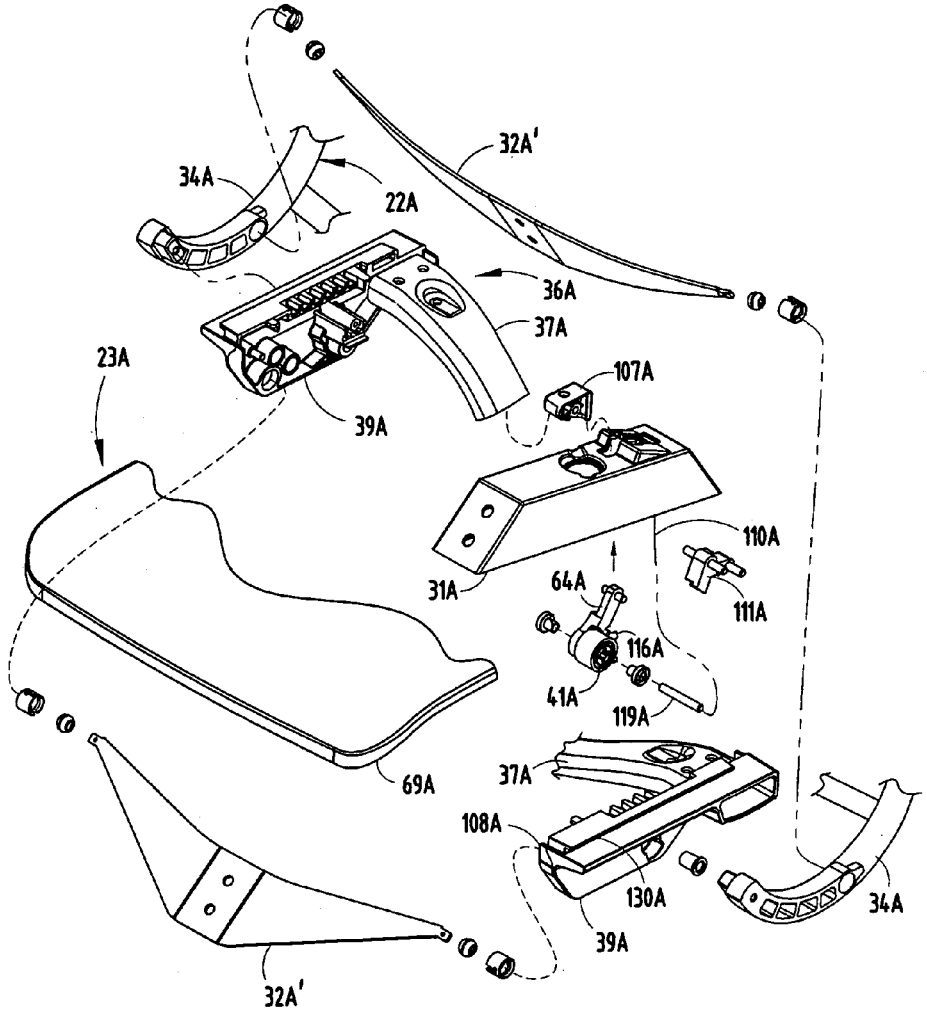
FIG. 16 is an exploded perspective view of FIG. 15.

The seating unit 20A (FIG. 14) includes a base 21A having a housing 31A with front and rear pairs of leaf-spring-like resilient support arms 32A and 32A' extending laterally and upwardly relative to each side of the housing 31A. A link arm 64A (FIG. 16) is pivoted to the housing 31A at a lower end by a pivot pin 119A. The seat 23A includes seat-supporting structure 36A in the form of crossbar 37A and side frame sections 39A (FIG. 15). The seat 23A is similar to the previously described seat 23, and includes a seat perimeter frame 69A for supporting a seated user. Addition detail will not be repeated, but it is noted that the application Ser. No. 10/792,309 provides additional discussion and was incorporated by reference above. An upper end of the link arm 64A is pivoted to the crossbar 37A at a pivot location defined by bracket 107A, and a rear end of the side frame sections 39A are operably rotatably engaged with the ends of the support arms 32A at locations 108A. This creates a non-aligned three-point support arrangement for supporting the seat-supporting structure 36A on the base 21A. The seat 23A is slidably positioned on the side frame sections 39A for depth adjustment on flanges 130A on side frame sections 39A that slidably engage mating flanges on the seat frame 69A. A latch is positioned between the seat frame 69A and side frame sections 39A to permit seat depth adjustment.

The back 21A (FIGS. 14–15) includes downwardly and forwardly extending arms 34A supported on ends of the rear support arms 32A'. Further, the back-supporting arms 34A are pivoted at location 108A to the side frame sections 39A. The rear resilient support arms 32A' are held at a forwardly tilted angle and the front resilient support arms 32A are held at a rearwardly tilted angle. Due to the interaction of forces, the result is that, upon recline of the back 22A, the arms 32A and 32A' flex, causing the seat 23A moves forwardly and upwardly (the front edge of the seat moving linearly and a rear edge of the seat moving arcuately about the pivot pin 119A described below).

Figure 17:
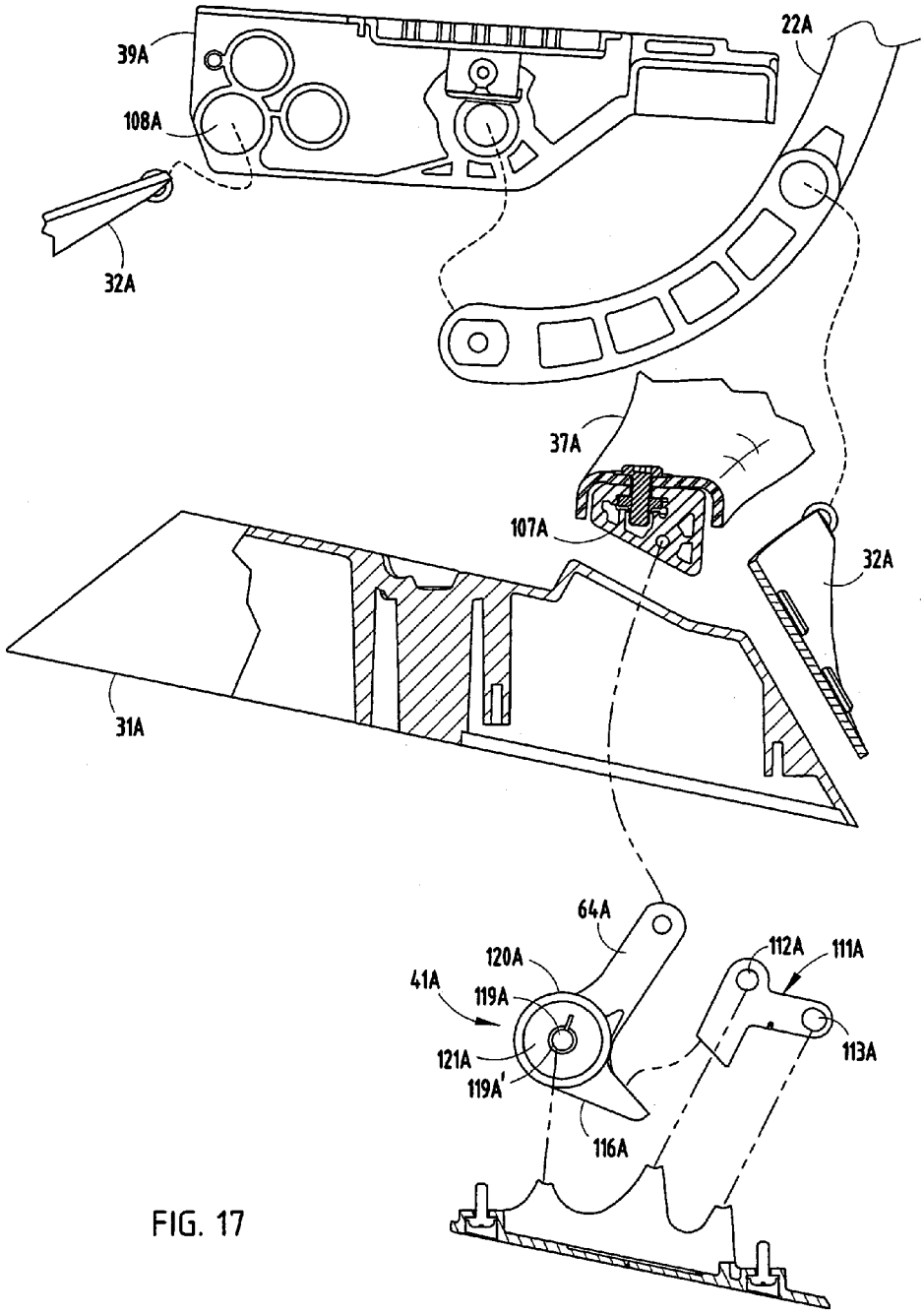
FIG. 17 is an exploded side view of FIG. 15.
Figure 18:
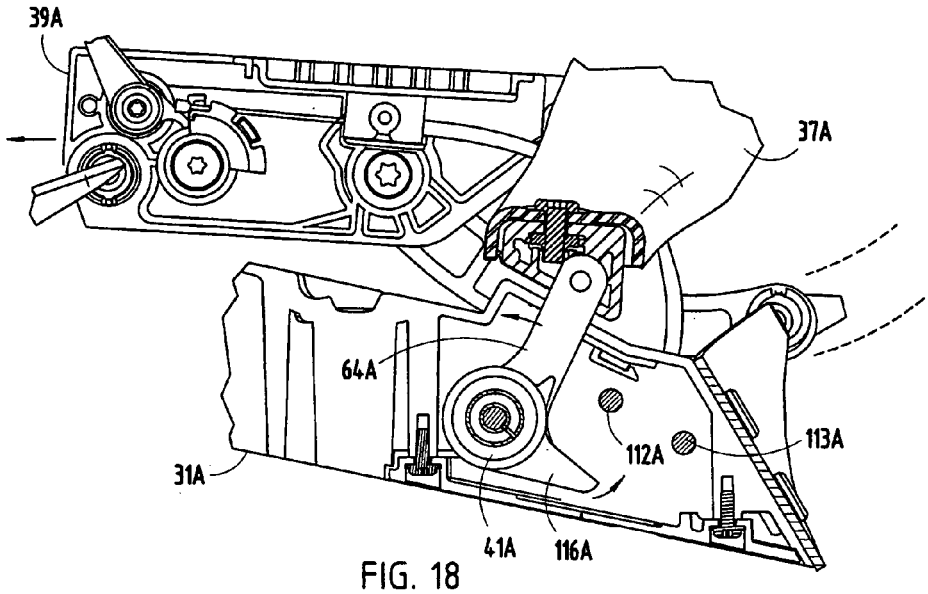
FIGS. 18–19 are side views showing operation of the selectively-operable booster spring mechanism of FIG. 16.
Figure 19:
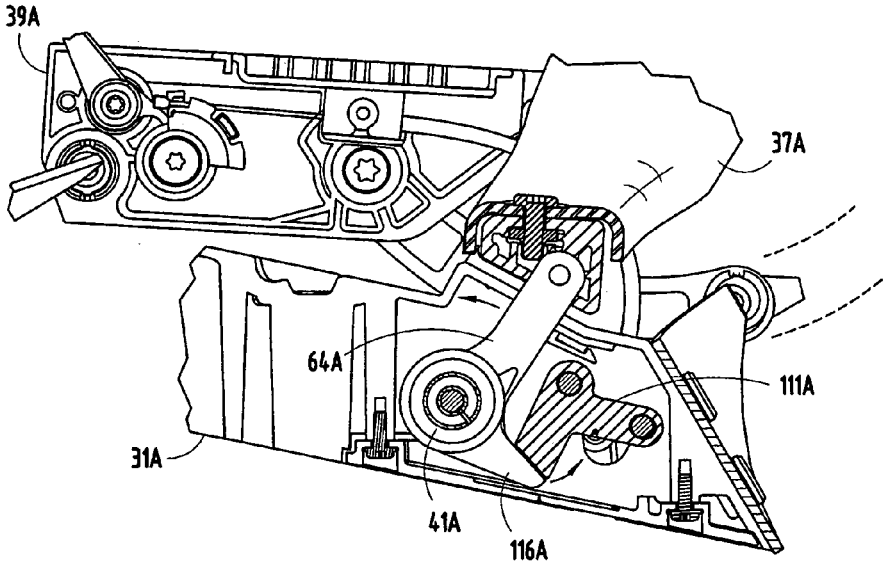

A selectively-engaged force-generating device in the form of a torsion spring 41A is positioned within the housing 31A on the pivot pin 119A for rotation about an axis 110A. The torsion spring 41A (FIG. 17) includes an inner ring member 119A' keyed to the pivot pin 119A. Since the pivot pin 119A is keyed to the movement of the link arm 64A, as the seat 23A moves during recline of the back 22A, the link arm 64A also is forced to move. Thus, the link arm 64A rotates in a synchronized coordinated fashion with the back 22A when the back 22A is reclined. The torsion spring 51A further includes an outer ring 120A with a radially-extending interference leg 116A, and a rubber torsion spring element 121A between the inner and outer ring members 118A and 120A. A selector stop member 111A is positioned on a pair of guide rods 112A and 113A within the housing 31A for lateral sliding movement via a Bowden cable and a remote control handle on a side of the seat 23A. When the selector stop member 111A is in a first position (FIG. 18), the selector stop member 111A does not engage the interference leg 116A on the torsion spring 41A but instead misses the leg 116A. As a result, the leg 116A (and spring 41A) is free to rotate, and does not provide any back support upon recline. Instead, the back support upon recline comes from the upward and forward movement of the seat 23A during recline (which is a weight-activated support feature where heavier seated users receive greater back support due to their heavier body weight), in combination with the energy-absorption that occurs by flexing of the resilient arms 32A and 32A'. Since the torsion spring 41A freely rotates, the torsion spring 41A is not active, and does not provide any bias during recline of the back 22A. Contrastingly, when the selector stop member 111A is moved to a second position (FIG. 19), the selector stop member 111A engages the outer leg 116A, preventing the outer ring 120A from rotating. At the same time, the keyed inner ring member 118A moves with the pivot pin 119A since it is keyed to the pivot pin 119A. This causes the torsion spring element 121A to be stretched and to provide a biasing force, called a "booster" force herein since it "boosts" (i.e. in other words increases) the amount of energy provided upon recline of the back 22A.

It is to be understood that variations and modifications can be made on the aforementioned structure without departing from the concepts of the present invention, and further it is to be understood that such concepts are intended to be covered by the following claims unless these claims by their language expressly state otherwise.

We claim:

1. A seating unit comprising:

a base having a housing and at least one support arm extending laterally relative to each side of the housing;

a force-generating device positioned within the housing;

a seat-supporting structure including a crossbar and fore-and-aft elongated side frame sections, each said side frame section having opposite ends, one of the opposite ends being attached to one of the ends of the cross bar to define a U-shape in top view, the cross bar being operably attached to the force generating device and extending laterally relative to the housing, the crossbar being operably supported for movement in a generally fore-and-aft direction relative to the housing and being biased by the force-generating device in a first direction toward an upright position and biased against movement in an opposite second direction toward a recline position; and a seat supported at least in part by the crossbar, with the seat support being operably positioned in spaced relation to the housing and being biased against movement in the second direction.

2. The seating unit defined in claim 1, wherein the crossbar includes a center region pivotally supported by the base and includes end sections that support the seat.

3. The seating unit defined in claim 1, including a load bearing member movably supported by the housing and supporting a front portion of the seat above the housing.

4. The seating unit defined in claim 3, wherein the load bearing member includes a slide member that slidably engages the housing.

5. The seating unit defined in claim 3, wherein the load bearing member includes a link member that is pivoted to the housing.

6. The seating unit defined in claim 3, wherein the at least one support arm includes a pair of opposite support arms, and including rear bearings supporting a rear portion of the seat on the support arms.

7. The seating unit defined in claim 1, wherein the second direction is oriented at an angle above horizontal so that upon movement toward the recline position, potential energy is stored as a seated user's body is lifted, such that the potential energy provides some weight-activated support to the seated user during movement toward the recline position.

8. The seating unit defined in claim 7, wherein the at least one support arm includes at least one flexible energy device.

9. The seating unit defined in claim 7, wherein said force-generating device is a boost mechanism that can be selectively engaged and disengaged.

10. The seating unit defined in claim 1, including a seat depth adjustment mechanism positioned between the seat and the seat-supporting member.

11. The seating unit defined in claim 1, wherein the seat includes a perimeter frame defining an opening and includes a support surface extending across the opening for supporting the seated user.

12. The seating unit defined in claim 11, wherein the support surface includes a comfort surface with resilient members adapted to distribute point loads on the support surface.

13. The seating unit defined in claim 1, wherein the base includes a height-adjustable pedestal and castors.

14. The seating unit defined in claim 1, wherein the seat-supporting structure is biased rearwardly by the force generating device.

15. The seating unit defined in claim 1, wherein the crossbar is located on top of the housing.

16. The seating unit defined in claim 1, including pivotal connections pivotally connecting the seat-supporting structure to the at least one support arm.

17. The seating unit defined in claim 1, including a reclineable back pivoted to the base.

18. The seating unit defined in claim 17, wherein the reclineable back includes lower arms pivotally attached to the at least one support arm.

19. The seating unit defined in claim 17, wherein the reclineable back includes an inverted U-shaped ribbon back support member that includes the lower arms.

20. The seating unit defined in claim 1, wherein the at least one support arm includes a pair of support arms comprising rigid structural members.

21. The seating unit defined in claim 20, including a back support member with lower arms pivoted to the at least one support arm and wherein the crossbar includes rearwardly extending side frame members having laterally-extending pivots that pivotally engage the lower arms of the back support member.

22. The seating unit defined in claim 1, including a cover on the housing.

23. The seating unit defined in claim 1, wherein the second direction is forward, with the seat being forwardly movable toward the recline position.

24. The seating unit defined in claim 1, including a back support member pivoted to the base and having a flexible back shell pivoted to the back support member at both top and bottom locations so that the back shell can be flexed for ergonomic support of a seated user without moving the back support member from the upright position.

25. The seating unit defined in claim 1, wherein the crossbar is pivoted to the housing for pivotal movement during movement toward the recline position.

26. The seating unit defined in claim 1, including a control for selectively actuating and deactuating the force-generating device.

27. The seating unit defined in claim 1, including a control for selectively adjusting a force of the force generating device.

28. A seating unit comprising:

a base having a housing and support arms extending laterally and upwardly on each side of the housing;

a back with lower arms pivoted to the support arms on each side;

a slide member slidably engaging the housing;

a seat-supporting structure including a crossbar pivotally attached to the slide member at a first pivot location and including side frame sections extending from ends of the crossbar, the side frame sections being pivotally attached to the lower arms of the back at a second pivot location spaced horizontally from the first pivot location; each said side frame section being elongated in a fore-aft direction and having opposite ends, one of the opposite ends being attached to one of the ends of the cross bar to define a U-shape in top view, the crossbar being adapted to move generally fore-and-aft relative to the housing, with the seat-supporting structure being adapted to stably support a seat above the housing; and a biasing device operably coupled to one of the back, the slide member and the seat-supporting structure that biases the back and the seat-supporting structure toward upright positions.

29. The seating unit defined in claim 28, wherein the side frame sections extend only forwardly from the cross bar.

30. The seating unit defined in claim 28, wherein the side frame sections extend only rearwardly from the cross bar.

31. The seating unit defined in claim 28, wherein the cross bar has a horizontally-extending lower center portion, angled intermediate portions extending from opposite ends of the lower center portion, and horizontally-extending raised outboard portions extending from outboard ends of the intermediate portions.

32. The seating unit defined in claim 28, including a seat attached to the seat-supporting structure and supported at a location spaced above a center of the crossbar.

33. The seating unit defined in claim 28, including a control for selectively actuating and deactuating the biasing device.

34. The seating unit defined in claim 28, including a control for selectively adjusting a force of the biasing device.

35. A seating unit comprising:

a base support structure;

a U-shaped seat-supporting structure including a crossbar slidably attached to the base support structure at a first location and including frame-engaging sections extending from ends of the crossbar, the frame-engaging sections being elongated in a fore-and-aft direction and having opposite ends, one of the opposite ends being attached to one of the ends of the cross bar to define a U-shape in top view, the cross bar being operably supported and coupled to the base support structure at a second pivot location spaced horizontally from the first location to define an arrangement including at least three non-aligned support points; the crossbar being adapted to move generally fore-and-aft relative to the base support structure;

a seat supported at the at least three non-aligned support points by the seat-supporting structure above the base support structure; and a biasing device operably coupled to at least one of the base support structure, the seat-supporting structure, and the seat that biases the seat from a recline position toward an upright position.

36. The seating unit defined in claim 35, wherein the side frame sections extend only forwardly from the cross bar.

37. The seating unit defined in claim 35, wherein the side frame sections extend only rearwardly from the cross bar.

38. The seating unit defined in claim 35, wherein the cross bar has a horizontally-extending lower center portion, angled intermediate portions extending from opposite ends of the lower center portion, and horizontally-extending raised outboard portions extending from outboard ends of the intermediate portions.

39. The seating unit defined in claim 35, including a seat attached to the seat-supporting structure and supported at a location spaced above the crossbar.

40. The seating unit defined in claim 35, including a control for selectively actuating and deactuating the biasing device.

41. The seating unit defined in claim 35, including a control for selectively adjusting a force of the biasing device.

42. A seat-supporting apparatus for use in a seating unit, where the seating unit includes a control housing, a seat, and a back operably supported on the control housing for synchronous movement upon recline of the back, the seat-supporting apparatus comprising:

a force-generating device positioned within the housing; and a seat-supporting structure including a crossbar operably attached to the force generating device and extending laterally relative to the housing for supporting the seat over the housing, the seat-supporting structure further including side frame sections that are attached to ends of the cross bar, the side frame sections each being elongated in a fore-and-aft direction and having opposite ends, one of the opposite ends being attached to one of the ends of the cross bar to define a U-shape in top view, the cross bar being the crossbar being operably movably supported at least in part by the crossbar on the control housing for movement in a generally fore-and-aft direction relative to the housing and being biased by the force-generating device in a first direction toward an upright position and biased against movement in the substantially opposite second direction toward a recline position.

43. The seating unit defined in claim 42, wherein the cross bar has a horizontally-extending lower center portion, angled intermediate portions extending from opposite ends of the lower center portion, and horizontally-extending raised outboard portions extending from outboard ends of the intermediate portions.

44. The seating unit defined in claim 42, wherein the side frame sections extend only forwardly from the cross bar.

45. The seating unit defined in claim 42, wherein the side frame sections extend only rearwardly from the cross bar.

46. The seating unit defined in claim 1, wherein the side frame sections extend only forwardly from the cross bar.

47. The seating unit defined in claim 1, wherein the side frame sections extend only rearwardly from the cross bar.

48. A seating unit comprising:

a base having a housing and at least one support arm extending laterally relative to each side of the housing;

a force-generating device positioned within the housing;

a seat-supporting structure including a crossbar operably attached to the force generating device and extending laterally relative to the housing, the crossbar being operably supported for movement in a generally fore-and-aft direction relative to the housing and being biased by the force-generating device in a first direction toward an upright position and biased against movement in an opposite second direction toward a recline position, the cross bar having a horizontally-extending lower center portion, angled intermediate portions extending from opposite ends of the lower center portion, and horizontally-extending raised outboard portions extending from outboard ends of the intermediate portions; and a seat supported at least in part by the crossbar, with the seat support being operably positioned in spaced relation to the housing and being biased against movement in the second direction.

49. The seating unit defined in claim 48, wherein the seat-supporting structure further includes side frame sections that are attached to ends of the cross bar, the side frame sections each being elongated in a fore-and-aft direction and having opposite ends, one of the opposite ends being attached to one of the ends of the cross bar to define a U-shape in top view.

50. The seating unit defined in claim 49, wherein the side frame sections extend only forwardly from the cross bar.

51. The seating unit defined in claim 49, wherein the side frame sections extend only rearwardly from the cross bar.

52. The seating unit defined in claim 1, wherein the cross bar has a horizontally-extending lower center portion, angled intermediate portions extending from opposite ends of the lower center portion, and horizontally-extending raised outboard portions extending from outboard ends of the intermediate portions.

* * * * *